US006464566B1

(12) United States Patent
Berman et al.

(10) Patent No.: US 6,464,566 B1
(45) Date of Patent: Oct. 15, 2002

(54) APPARATUS AND METHOD FOR LINEARLY PLANARIZING A SURFACE OF A SEMICONDUCTOR WAFER

(75) Inventors: Michael J. Berman; Jayashree Kalpathy-Cramer, both of West Linn, OR (US)

(73) Assignee: LSI Logic Corporation, Milpitas, CA (US)

( * ) Notice: Subject to any disclaimer, the term of this patent is extended or adjusted under 35 U.S.C. 154(b) by 14 days.

(21) Appl. No.: 09/607,177

(22) Filed: Jun. 29, 2000

(51) Int. Cl.[7] ..... B24D 11/00

(52) U.S. Cl. ..... 451/36; 451/39; 451/41; 451/59; 451/63

(58) Field of Search ..... 451/36, 41, 59, 451/63, 296, 307, 526, 533; 264/210.2

(56) References Cited

U.S. PATENT DOCUMENTS

| | | | | |
|---|---|---|---|---|
| 5,245,790 | A | | 9/1993 | Jerbic |
| 5,265,378 | A | | 11/1993 | Rostoker |
| 5,310,455 | A | | 5/1994 | Pasch et al. |
| 5,321,304 | A | | 6/1994 | Rostoker |
| 5,389,194 | A | | 2/1995 | Rostoker et al. |
| 5,403,228 | A | | 4/1995 | Pasch |
| 5,516,400 | A | | 5/1996 | Pasch et al. |
| 5,624,304 | A | | 4/1997 | Pasch et al. |
| 5,626,715 | A | | 5/1997 | Rostoker |
| 5,667,433 | A | | 9/1997 | Mallon |
| 5,702,292 | A | * | 12/1997 | Brunelli et al. ..... 451/41 |
| 5,861,055 | A | | 1/1999 | Allman et al. |
| 5,865,666 | A | | 2/1999 | Nagahara |
| 5,868,608 | A | | 2/1999 | Allman et al. |
| 5,882,251 | A | | 3/1999 | Berman et al. |
| 5,888,120 | A | | 3/1999 | Doran |
| 5,893,756 | A | | 4/1999 | Berman et al. |
| 5,931,719 | A | | 8/1999 | Nagahara et al. |
| 5,948,697 | A | | 9/1999 | Hata |
| 5,957,757 | A | | 9/1999 | Berman |
| 6,212,858 | B1 | * | 4/2001 | Lombardo ..... 451/526 |
| 6,213,858 | B1 | * | 4/2001 | Lombardo ..... 451/526 |

* cited by examiner

*Primary Examiner*—Timothy V. Eley
*Assistant Examiner*—Alvin J. Grant
(74) *Attorney, Agent, or Firm*—Maginot, Moore & Bowman, LLP

(57) ABSTRACT

An apparatus for planarizing a surface of a semiconductor wafer includes a wafer support configured to receive the semiconductor wafer so that the surface of the semiconductor wafer projects from the wafer support. The apparatus also includes a polishing member configured in the form of an endless unitary belt which is devoid of seams. The endless unitary belt is (i) positioned in contact with the surface of the semiconductor wafer and (ii) capable of moving in a linear direction relative to the surface of the semiconductor wafer so as to planarize the surface of the semiconductor wafer. An associated method of linearly planarizing a surface of a semiconductor is also described.

19 Claims, 5 Drawing Sheets

APPARATUS AND METHOD FOR LINEARLY PLANARIZING A SURFACE OF A SEMICONDUCTOR WAFER

TECHNICAL FIELD OF THE INVENTION

The present invention relates generally to planarizing a surface of a semiconductor wafer, and more particularly to an apparatus and method for linearly planarizing a surface of a semiconductor wafer with a belt.

BACKGROUND OF THE INVENTION

The available systems for the chemical mechanical planarization (CMP) of semiconductor wafers typically employ a rotating wafer holder for supporting the wafer and a polishing pad which is rotated relative to the wafer surface. The wafer holder presses the wafer surface against the polishing pad during the planarization process and rotates the wafer about an axis relative to the polishing pad. The polishing pad is carried by a polishing wheel or platen which is rotated about a another axis different from the rotational axis of the wafer holder. A polishing agent or slurry is applied to the polishing pad to chemically enhance the polishing of the wafer. As the wafer holder and the polishing wheel are each rotated about their respective central axes, an arm moves the wafer holder in a direction parallel to the surface of the polishing wheel.

Since the polishing rate applied to the wafer surface is proportional to the relative velocity of the polishing pad, the polishing rate at a selected point on the wafer surface depends upon the distance of the selected point from the axis of rotation. Thus, the polishing rate applied to the edge of the wafer closest to the rotational axis of the polishing pad is less than the polishing rate applied to the opposite edge of the wafer. Rotating the wafer throughout the planarization process averages the polishing rate applied across the wafer surface so that a uniform average polishing rate is applied to the wafer surface. Although the average polishing rate may be uniform, the wafer surface is continuously exposed to a variable polishing rate during the planarization process. In addition, fluid dynamic and thermodynamic factors effect the chemical reactions occurring during the planarization process and can influence the actual polishing rate at any given instant in time. The aforementioned effects are not uniform across the wafer surface, and thus can have a detrimental effect on the planarization process. Moreover, instead of "averaging" the effects, the relative rotation of the wafer and the polishing pad contribute to the fluid dynamics and thermodynamics of the chemical reaction taking place on the wafer surface and can thus further decrease the uniformity of the polishing rate.

One technique for obtaining a more uniform polishing rate is to utilize a linear polisher. Instead of a rotating pad, a moving belt is used to linearly move the pad across the wafer surface. The wafer is still rotated for averaging out the local variations, but the global planarity is improved over CMP tools using rotating pads. However, a significant problem associated with the belt utilized in linear polisher systems is that the belt is constructed from a number of individual segments which are secured adjacent to one another on a backing in such a way so as to create one or more seams in the belt. Therefore, each belt has a number of seams defined thereon which decrease the surface uniformity of the belt which can in turn adversely effect the planarization of the wafer surface. For example, slurry can accumulate and coagulate in the seams and scratch the surface of the wafer during the CMP process. The aforementioned problems cause increase the defectivity of the wafer and thus decrease the reliability of the CMP process to produce uniformly planarized. Moreover, the belts are more likely to peel at the seams which decreases the belt life and thus increases the cost of the CMP process.

Thus, a continuing need exists for a method and an apparatus for planarizing a semiconductor wafer which addresses the above described problems.

SUMMARY OF THE INVENTION

In accordance with one embodiment of the present invention, there is provided an apparatus for planarizing a surface of a semiconductor wafer. The apparatus includes a wafer support configured to receive the semiconductor wafer so that the surface of the semiconductor wafer projects from the wafer support. The apparatus also includes a polishing member configured in the form of an endless belt which is devoid of seams. The endless belt is (i) positioned in contact with the surface of the semiconductor wafer and (ii) capable of moving in a linear direction relative to the surface of the semiconductor wafer so as to planarize the surface of the semiconductor wafer.

In accordance with another embodiment of the present invention, there is provided a method of planarizing a surface of a semiconductor wafer. The method includes the steps of (i) positioning an endless belt which is devoid of seams in contact with the surface of the semiconductor wafer and (ii) moving the endless belt in a linear direction relative to the semiconductor wafer so as to planarize the surface of the semiconductor wafer.

In accordance with yet another embodiment of the present invention, there is provided an apparatus for planarizing a surface of a semiconductor wafer. The apparatus includes a wafer support configured to receive the semiconductor wafer so that the surface of the semiconductor wafer projects from the wafer support. The apparatus also includes a polishing member configured in the form of an endless unitary belt which is devoid of seams. The endless unitary belt is produced by a process which includes the steps of (i) melting a material, (ii) injecting the melted material into a cavity defined in a mold, and (iii) solidifying the melted material within the cavity so as to produce the endless unitary belt. The endless unitary belt is (i) positioned in contact with the surface of the semiconductor wafer and (ii) capable of moving in a linear direction relative to the surface of the semiconductor wafer so as to planarize the surface of the semiconductor wafer. The apparatus further includes a slurry dispensing mechanism for dispensing a chemical slurry on the endless unitary belt.

It is an object of the present invention to provide a new and useful apparatus and method for linearly planarizing a surface of a semiconductor wafer.

It is also an object of the present invention to provide an improved apparatus and method for linearly planarizing a surface of a semiconductor wafer.

It is yet another object of the present invention to provide an apparatus and method which enhances the uniformity of linearly planarizing a surface of a semiconductor wafer.

The above and other objects, features, and advantages of the present invention will become apparent from the following description and the attached drawings.

DETAILED DESCRIPTION OF A PREFERRED EMBODIMENT

Figure 1:
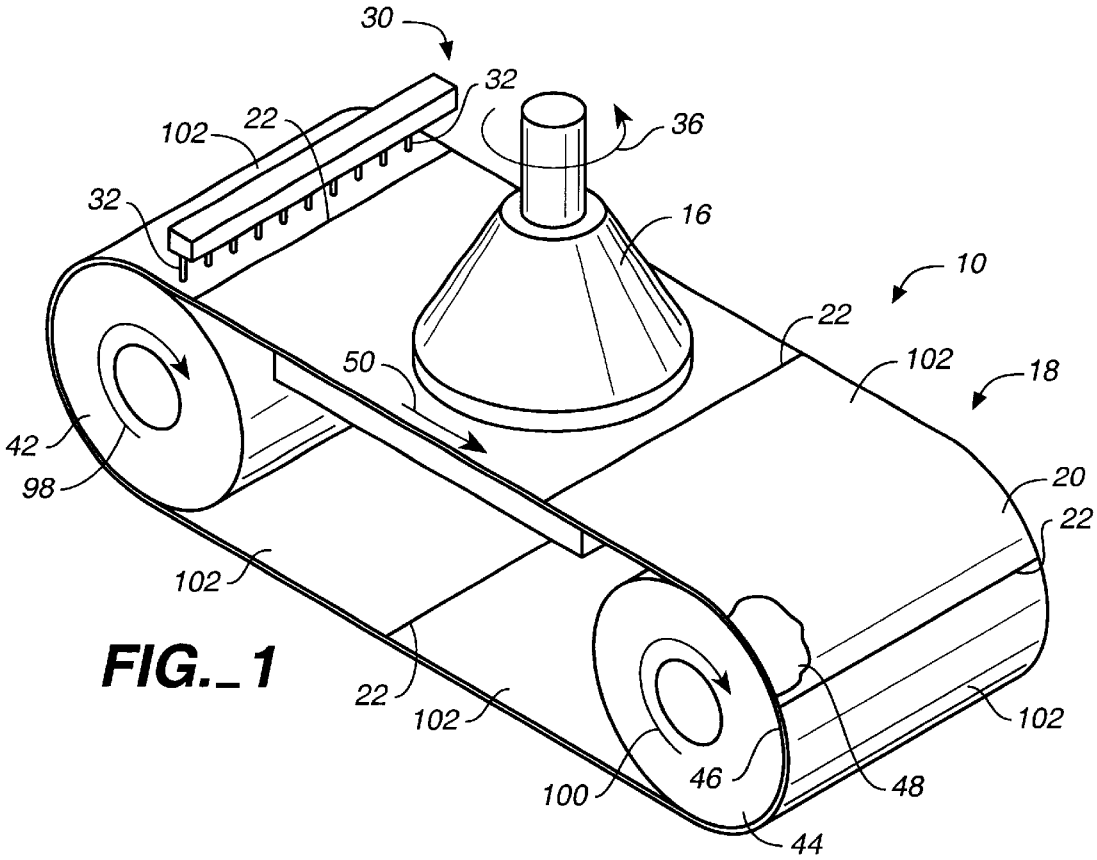
FIG. 1 is a perspective view of an apparatus for planarizing a surface of a semiconductor wafer which utilizes a belt having a number of seams defined therein (note that a portion of the belt has been removed for clarity of description)

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 3:
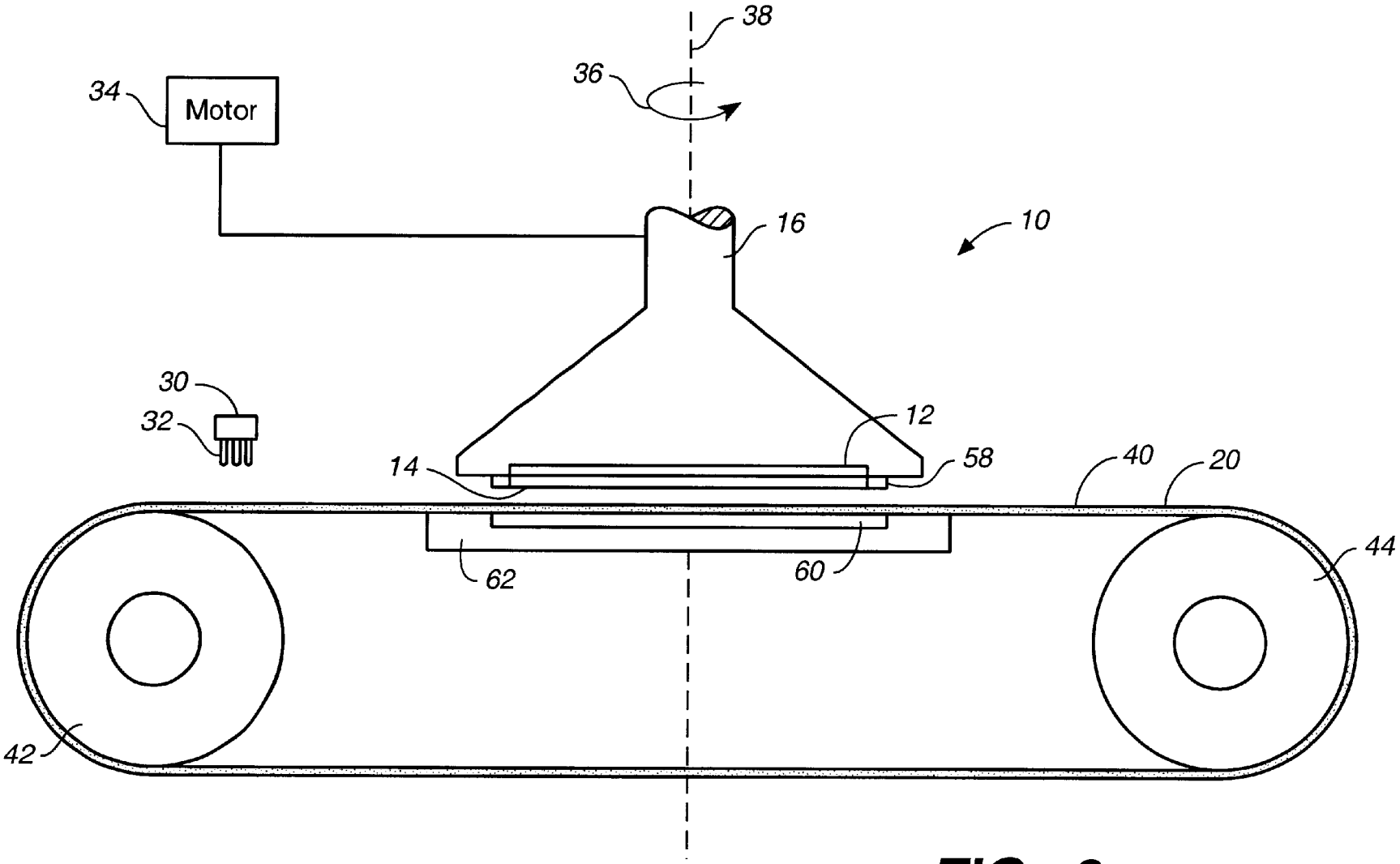
FIG. 3 is a partially schematic side elevational view of the apparatus of FIG. 1 showing a motor operatively coupled to the wafer support of the apparatus.
Figure 4:
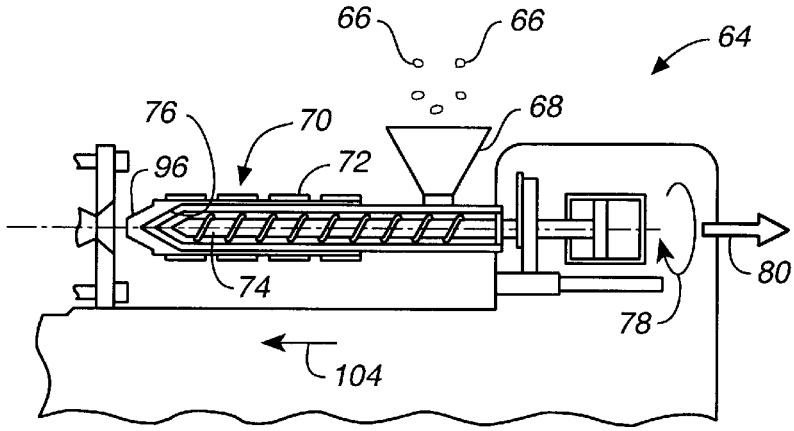
FIG. 4 is a fragmentary side elevational view of an injection molding apparatus which can be utilized to manufacture the endless unitary belt of the present invention.
Figure 5:
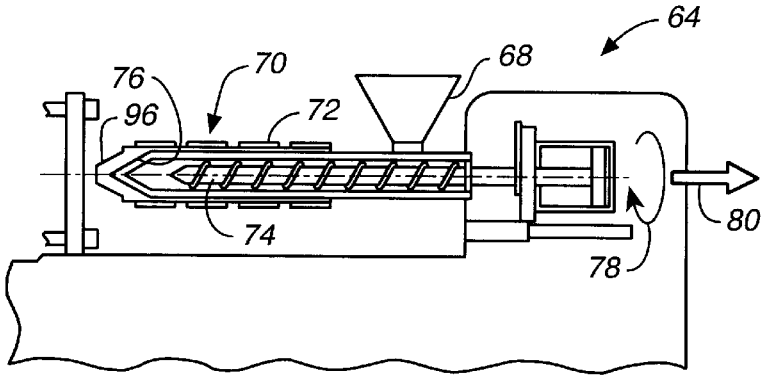
FIG. 5 is another fragmentary side elevational view of the injection molding apparatus of FIG. 4.
Figure 6:
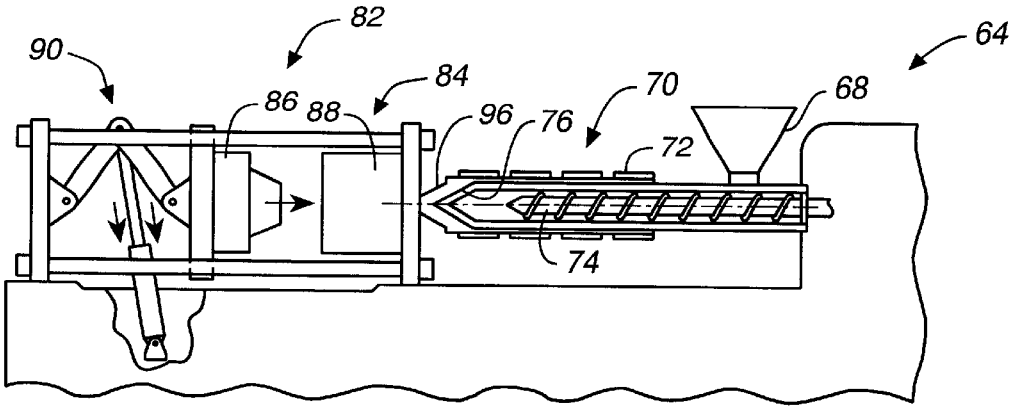
FIG. 6 is a side elevational view of the injection molding apparatus of FIG. 4 showing the mold assembly and actuating mechanism thereof.
Figure 7:
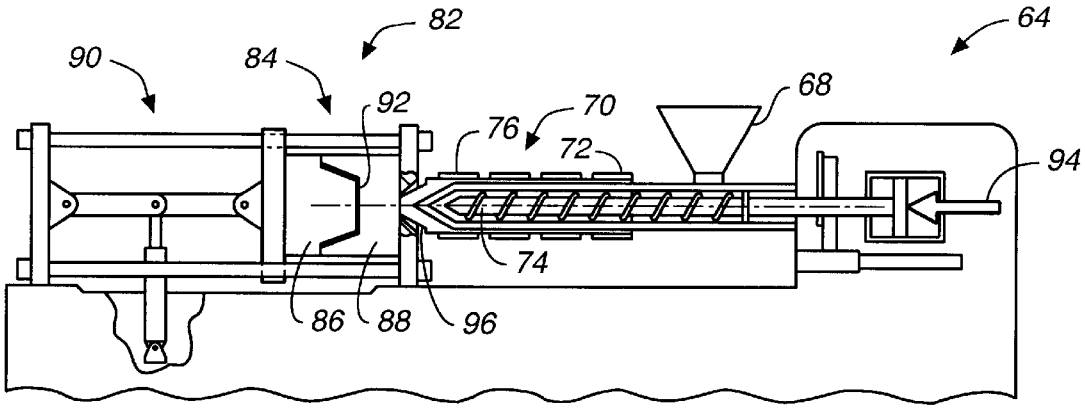
FIG. 7 is another side elevational view of the injection molding apparatus of FIG. 4 showing the mold assembly and actuating mechanism thereof.

Referring to FIGS. 1 and 3, there is shown an apparatus 10 for linearly planarizing a surface 14 of a semiconductor wafer 12, such as a silicon wafer. The material removed from surface 14 of wafer 12 during the aforementioned planarization process can be substrate material from wafer 12 or one of the layers formed on the substrate of wafer 12. The layers formed on the substrate of wafer 12 include dielectric materials (such as silicon dioxide) and metals (such as tungsten and copper). More specifically, apparatus 10 utilizes a technique generally known in the art as chemical mechanical planarization (CMP) to polish one or more of these layers fabricated on wafer 12, in order to planarize surface 14 of wafer 12. Generally, the art of performing CMP to polish away layers on a wafer is known and the prevalent practice has been to perform CMP by subjecting the surface of the wafer to a rotating a pad as previously discussed.

Apparatus 10 is unlike the aforementioned rotating pad device in current practice. In particular, apparatus 10 utilizes a polishing member 18 configured as a belt 20. Belt 20 is disposed around rollers 42 and 44 which are operatively coupled to a motor (not shown) for rotating roller 42 and 44 in the directions indicated by arrows 98 and 100. Rotating rollers 42 and 44 in the above described manner causes belt 20 to be driven in a linear motion with respect to wafer 12, as shown by arrow 50.

It should be understood that belt 20 is made up of a number of discrete unitary sections 102 which are affixed onto a support surface 48 of a belt support 46 such that belt support 46 is interposed between the rollers and sections 102. Thus, sections 102 of belt 20 and belt support 46 move linearly relative to wafer 12 as a single assembled unit as rollers 42 and 44 are rotated in the above described manner. It should be appreciated that forming belt 20 in the above described manner results in a number of seams 22 being formed between adjacent sections 102 of belt 20. What is meant herein by seams is a line, indentation, or protrusion that marks the joining of two edges. In particular, the line, indentation, or protrusion created in belt 20 by juxtaposing discrete unitary sections 102.

Still referring to FIGS. 1 and 3, wafer 12 is positioned within a wafer support 16 such that surface 14 of wafer 12 projects from wafer support 16. Wafer 12 is held within wafer support 16 by a retaining ring 58. A primary purpose of the retainer ring 58 is to retain wafer 12 in wafer support 16 so that wafer 12 will not move horizontally as belt 20 is driven linearly across surface 14 of wafer 12. Wafer support 16 is operatively coupled to a motor 34 such that motor 34 can rotate wafer support 16 (and thus wafer 12) in a direction indicated by arrow 36 around an axis 38 positioned in a perpendicular relationship with an outer surface 40 of belt 20. The rotation of wafer support 16 and thus wafer 12 allows for averaging of the polishing contact of surface 14 with belt 20.

Apparatus 10 also includes a slurry dispensing mechanism 30 for dispensing a chemical slurry 32 on belt 20 during planarization of surface 14 of wafer 12. Chemical slurry 32 is necessary for proper CMP of the wafer 12. During use of apparatus 10 a conditioner (not shown) is employed to recondition belt 20. Techniques for reconditioning belt 20 during use are known in the art and generally require a constant scratching of belt 20 in order to remove the residue build-up caused by the used slurry and removed waste material. One of a variety of conditioning devices can be readily adapted for use with apparatus 10.

Apparatus 10 also includes a platen 60 disposed on the underside of belt 20 and opposite from carrier 16, such that belt 20 resides between platen 60 and wafer 12. Platen 60 is typically attached to a support housing 62 positioned to provide support for platen 60. A primary purpose of platen 60 is to provide a supporting platform on the underside of belt 20 to ensure that belt 20 makes sufficient contact with surface 14 of wafer 12 for uniform planarization thereof. Typically, wafer support 16 is pressed downward against belt 20 with appropriate force so that wafer 12 makes sufficient contact with belt 20 for performing CMP. Since belt 20 and belt support 46 are flexible and will depress when wafer 12 is pressed downward onto belt 20, platen 60 provides a counteracting force to this downward force.

It should be appreciated that a disadvantage of apparatus 10 is that the aforementioned seams 22 create surface irregularities on belt 20. These surface irregularities cause defects in surface 14 of wafer 12 during the planarization process. For example, the surface irregularities can create scratches in surface 14 of wafer 12 as belt 20, and thus seams 22, pass over surface 14. It should be understood that these defects have a detrimental effect on the planarization of wafer 12.

Figure 2:
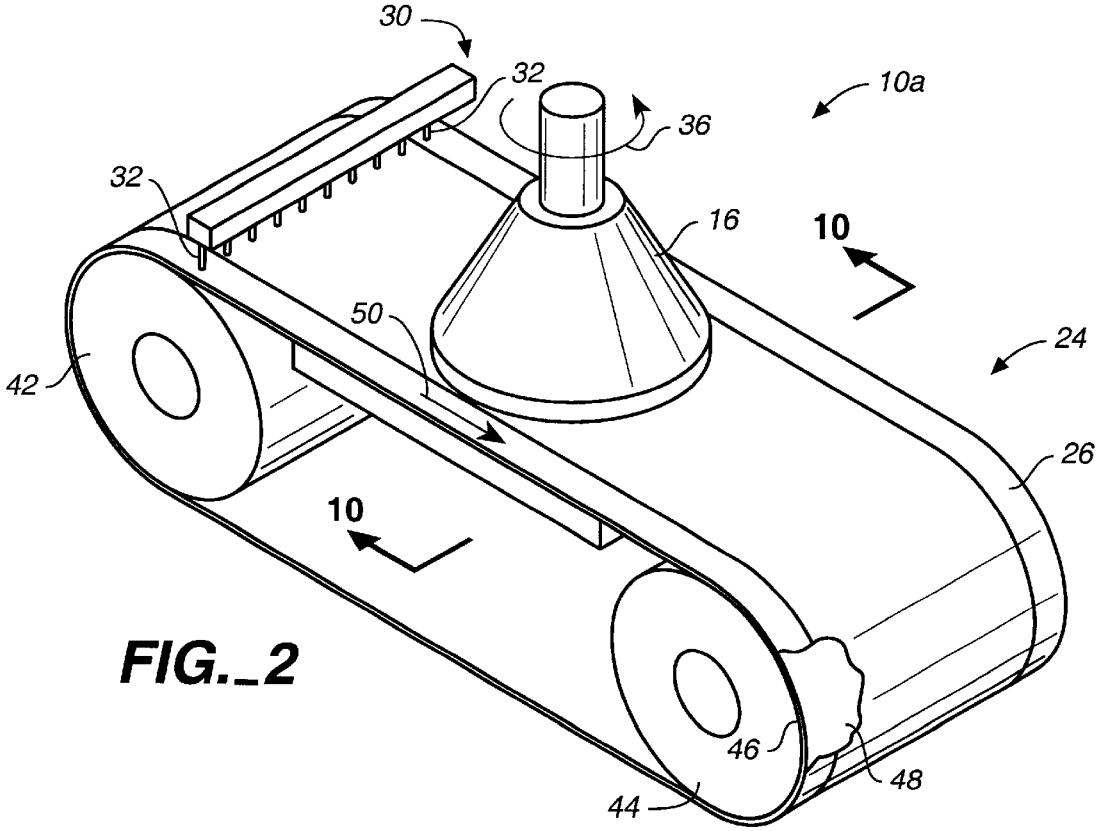
FIG. 2 is a perspective view of the apparatus of FIG. 1 utilizing an endless unitary belt which is devoid of seams instead of the belt shown in FIG. 1 which has a number of seams defined therein (note that a portion of the endless unitary belt has been removed for clarity of description)

Referring now to FIG. 2, there is shown an apparatus 10*a* which incorporates the features of the present invention therein. Apparatus 10*a* is substantially identical to apparatus 10 discussed above in reference to FIGS. 1 and 3 with the exception that apparatus 10*a* utilizes a polishing member 24 in the form of an endless unitary belt 26 which is devoid of seams rather than the above described belt 20. In other words belt 20 is substituted with belt 26. It should be appreciated that belt 26 differs from belt 20 in that, preferably, belt 26 is fabricated from a single unitary piece of material, as opposed to belt 20 which is fabricated from a plurality of discrete sections 102 which are juxtaposed to each other on support surface 48 thereby creating a number of seams 22 in belt 20. Fabricating belt 26 from a single unitary piece of material results in belt 26 being devoid of any seams since there are no discrete sections to join together. However, methods of fabricating belt 26 out of a plurality of discrete sections and then joining the discrete sections together so as to form belt 26 are contemplated in the present invention so long as the fabrication technique does not result in seams being formed or created in belt 26. It should be appreciated that belt 26 is also secured to support surface 48 of belt support 46 in a substantially identical manner as described above for belt 20 (e.g. utilizing an adhesive).

Apparatus 10*a* and belt 26 are utilized to planarize surface 14 of wafer 12 in a substantially identical manner as that described above in reference to apparatus 10. However, it should be understood that having belt 26 devoid of any seams is an advantage of the present invention. In particular, fabricating belt 26 so as to be devoid of any seams on the surface thereof significantly decreases the surface irregularities of belt 26 and thus substantially prevents the aforementioned defects being formed in surface 14 of wafer 12 during the planarization process. Therefore, having belt 26 devoid of any seams enhances the planarization of wafer 12.

Referring to FIGS. 4–9, there is shown an injection molding apparatus 64 which can be utilized to fabricate belt 26 of the present invention out of a plastic material, however, it should be understood that it is contemplated that other apparatus and materials can be utilized to fabricate belt 26. What is meant herein by plastic material is a polymeric material of large molecular weight which can be shaped by flow. Examples of plastic materials include polyethylene and polyurethane.

Apparatus 64 includes a plasticating unit 70, a hopper 68, an actuating mechanism 90, and a mold assembly 82 (see FIGS. 6–9). Plasticating unit 70 includes a barrel 72 having a nozzle 96 defined on an end thereof. Plasticating unit 70 also includes a screw 74 positioned within a screw chamber 76 defined by barrel 72. It should be appreciated that screw 74 is meshingly engaged with threads defined on an interior surface of barrel 72. It should also be appreciated that hopper 68 is in communication with screw chamber 76 such that material placed into hopper 68 is advanced into screw chamber 76.

Mold assembly 82 includes a mold 84 having a first half 86 and a second half 88. Mold 84 can be positioned between an open position (see FIGS. 6 and 9) and a closed position (see FIGS. 7 and 8) by actuating mechanism 90. When mold 84 is located in the closed position mold 84 defines a cavity 92. Cavity 92 is configured to produce belt 26 during the below described injection molding process.

Apparatus 64 is utilized to fabricate belt 26 in the following manner. A plastic material 66 (see FIG. 4) in the form of pellets or powder is placed into hopper 68 where plastic material 66 is advanced into screw chamber 76. The plastic material 66 is melted in screw chamber 76 by friction and by additional heater bands (not shown) disposed around barrel 72.

As the plastic material 66 is melted, screw 74 is rotated in the direction indicated by arrow 78 so as to transport the melted plastic material 66 in the direction indicated by arrow 104 to a location in screw chamber 76 which is interposed between an end of screw 74 and nozzle 96. Because of the increasing volume of the melted plastic in front of screw 74, screw 74 moves axially backward in the direction indicated by arrow 80. Screw 74 moves axially backward until a rear limiting switch is actuated and the rotation of screw 74 stops. The limiting switch is set in such a manner that the volume of melted plastic located interposed between the end of screw 74 and nozzle 96 is precisely the volume required for injecting into cavity 92 (see FIG. 7) defined by mold 84 in the closed position.

Figure 8:
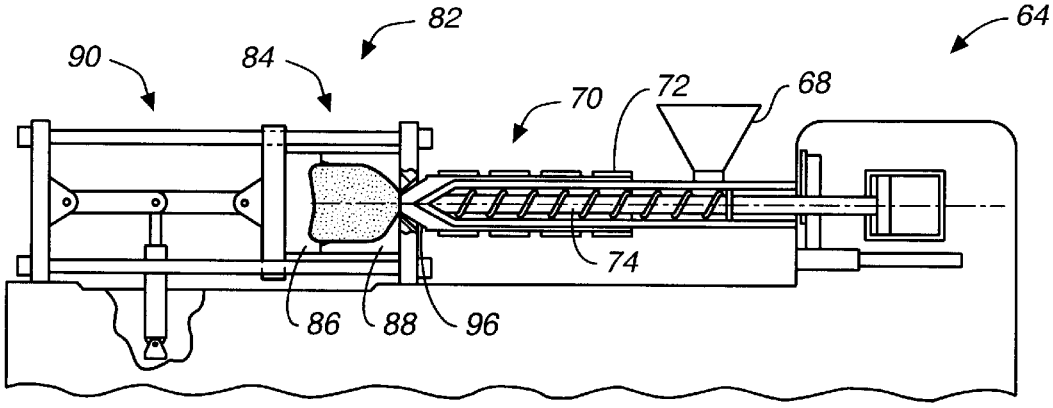
FIG. 8 is still another side elevational view of the injection molding apparatus of FIG. 4 showing the mold assembly and actuating mechanism thereof.
Figure 9:
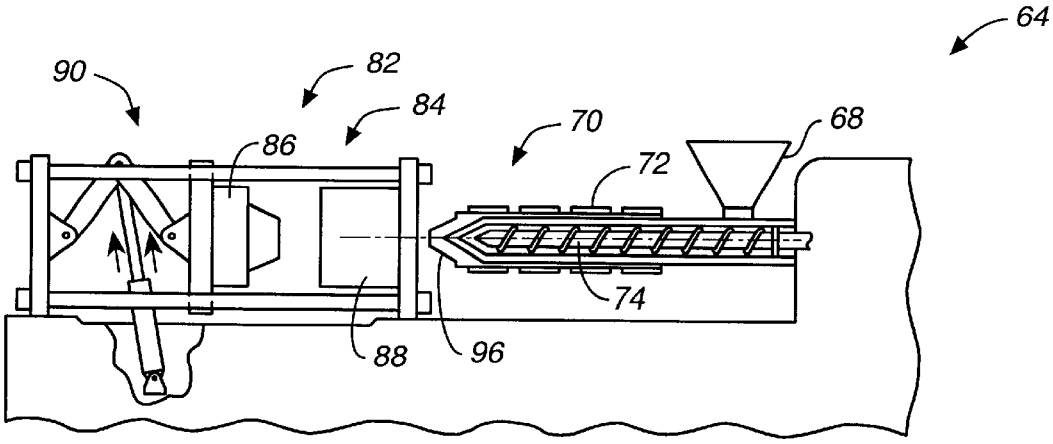
FIG. 9 is still another side elevational view of the injection molding apparatus of FIG. 4 showing the mold assembly and actuating mechanism thereof.

Once the above described volume of melted plastic material is located interposed between the end of screw 74 and nozzle 96, actuating mechanism 90 causes first half 86 and second half 88 of mold 84 to come together in the close position and thereby form cavity 92. Once mold 84 is located in the closed position, nozzle 96 of barrel 72 is placed in fluid communication with cavity 92 of mold 84. Screw 74 is then pushed forward in the direction indicated by arrow 94 (see FIG. 7) forcing the melted plastic material from screw chamber 76 through nozzle 96 into cavity 92 as indicated in FIG. 8.

As the injected plastic material solidifies within cavity 92, screw 74 advances additional melted plastic material into cavity 92 under a holding pressure to compensate for the volume contraction of the melted plastic material as it cools and solidifies. Once the melted plastic material has solidified, actuating mechanism 90 causes mold 84 to be located in the open position (see FIG. 9) and belt 26 is ejected from cavity 92 with assistance from an ejector system (not shown) inside mold 84.

Figure 10:
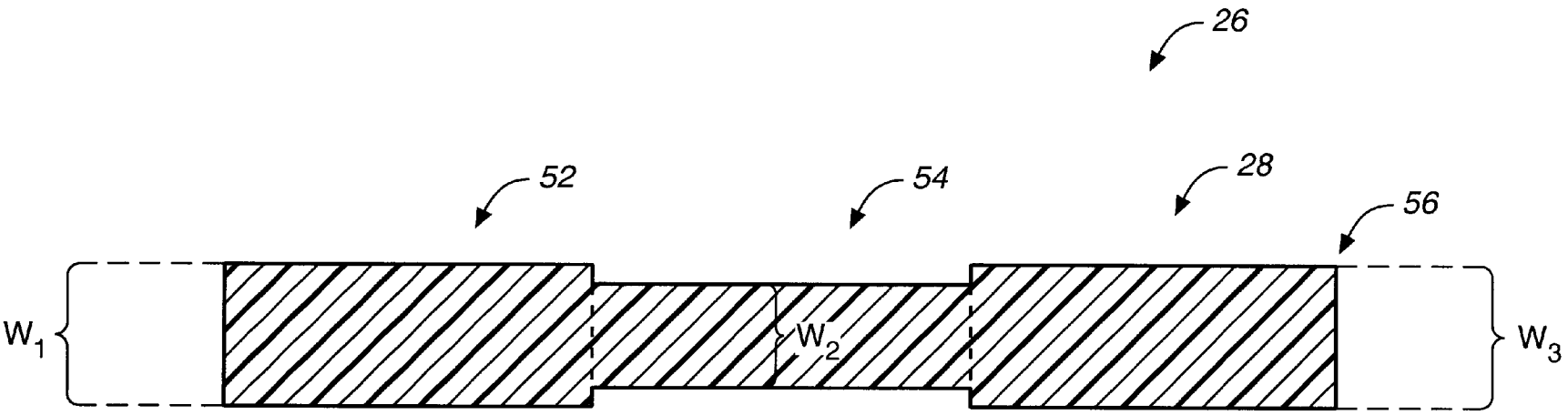
FIG. 10 is a transverse cross-sectional view of one embodiment of the endless unitary belt of the present invention taken along the line 10—10 of FIG. 2 as viewed in the direction of the arrow.

It should be appreciated that cavity 92 of mold 84 can be configured to produce belts 26 having different shapes. For example, as shown in FIG. 10, cavity 92 can be configured to produce a belt 26 that has a transverse cross-sectional area 28 which includes (i) a first portion 52 having a width $W_1$, (ii) a second portion 54 having a width $W_2$, and (iii) a third portion 56 having a width $W_3$. With widths $W_1$ and $W_3$ being greater than width $W_2$. Having a belt 26 possessing portions with differing widths enhances the versatility of belt 26 in the planarization process.

While the invention has been illustrated and described in detail in the drawings and foregoing description, such illustration and description is to be considered as exemplary and not restrictive in character, it being understood that only preferred embodiments have been shown and described and that all changes and modifications that come within the spirit of the invention are desired to be protected.

What is claimed is:

1. An apparatus for planarizing a surface of a semiconductor wafer, comprising:

a wafer support configured to receive said semiconductor wafer so that said surface of said semiconductor wafer projects from said wafer support; and a polishing member configured in the form of an endless belt which is devoid of seams, said endless belt secured to a belt support using an adhesive, wherein said endless belt is (i) positioned in contact with said surface of said semiconductor wafer and (ii)

capable of moving in a linear direction relative to said surface of said semiconductor wafer so as to planarize said surface of said semiconductor wafer.

2. The apparatus of claim 1, wherein:

a transverse cross-sectional area of said endless belt has (i) a first portion having a width $W_1$ and (ii) a second portion having a width $W_2$, wherein said width $W_1$ is greater than said width $W_2$.

3. The apparatus of claim 1, wherein:

said endless belt is produced by a process which includes the steps of (i) melting a plastic material, (ii) injecting said melted plastic material into a cavity defined in a mold, and (iii) solidifying said melted plastic material within said cavity so as to produce said endless belt.

4. The apparatus of claim 1, further comprising:

a slurry dispensing mechanism for dispensing a chemical slurry on said endless belt during said planarization of said surface of said semiconductor wafer.

5. The apparatus of claim 1, wherein:

said endless belt is fabricated from polyurethane.

6. The apparatus of claim 1, further comprising:

a motor operatively coupled to said wafer support such that said motor rotates said wafer support and said semiconductor wafer around an axis positioned in a perpendicular relationship with an outer surface of said endless belt.

7. The apparatus of claim 1, further comprising:

a first roller; and a second roller, wherein (i) said endless belt is disposed around said first roller and said second roller and (ii) said first roller and said second roller define a path of rotation for said endless belt.

8. A method of planarizing a surface of a semiconductor wafer, comprising the steps of:

forming a belt devoid of seams using injection molding;

securing the belt to a belt support after said forming;

positioning the belt in contact with said surface of said semiconductor wafer; and moving said belt and belt support in a linear direction relative to said semiconductor wafer so as to planarize said surface of said semiconductor wafer.

9. The method of claim 8, further comprising the step of:

rotating said semiconductor wafer relative to said belt during said moving step.

10. The method of claim 8, further comprising the step of:

applying a chemical slurry to said surface of said semiconductor wafer during said moving step.

11. The method of claim 8, wherein said forming step further comprises:

melting a plastic material, injecting said melted plastic material into a cavity defined in a mold, and solidifying said plastic material within said cavity so as to produce said belt.

12. The method of claim 8, further comprising the step of:

disposing said belt and belt support around a first roller and a second roller such that said first roller and said second roller define a path of rotation for said endless belt.

13. The method of claim 8, wherein the securing step further comprises securing the belt to the belt support using an adhesive.

14. An apparatus for planarizing a surface of a semiconductor wafer, comprising:

a wafer support configured to receive said semiconductor wafer so that said surface of said semiconductor wafer projects from said wafer support;

a polishing member configured in the form of a belt support and an endless unitary belt which is devoid of seams, said polishing member produced by a process which includes the steps of (i) melting a material, (ii) injecting said melted material into a cavity defined in a mold, (iii) solidifying said melted material within said cavity so as to produce said endless unitary belt, and (iv) securing the endless unitary belt to belt support, wherein said endless unitary belt is (i) positioned in contact with said surface of said semiconductor wafer and (ii) capable of moving in a linear direction relative to said surface of said semiconductor wafer so as to planarize said surface of said semiconductor wafer; and a slurry dispensing mechanism for dispensing a chemical slurry on said endless unitary belt.

15. The apparatus of claim 14, wherein:

a transverse cross-sectional area of said endless unitary belt has (i) a first portion having a width $W_1$ and (ii) a second portion having a width $W_2$, wherein said width $W_1$ is greater than said width $W_2$.

16. The apparatus of claim 14, further comprising:

a motor operatively coupled to said wafer support such that said motor rotates said wafer support and said semiconductor wafer around an axis positioned in a perpendicular relationship with an outer surface of said endless unitary belt.

17. The apparatus of claim 14, further comprising:

a first roller; and a second roller, wherein (i) said endless unitary belt is disposed around said first roller and said second roller and (ii) said first roller and said second roller define a path of rotation for said endless unitary belt.

18. The apparatus of claim 14, wherein:

said endless unitary belt is fabricated from polyurethane.

19. The apparatus of claim 14, wherein said polishing member is produced by a process which further includes the step of securing the endless unitary belt to the belt support using an adhesive.

* * * * *